United States Patent [19]

Rotherham

[11] Patent Number: 4,532,748

[45] Date of Patent: Aug. 6, 1985

[54] BUILDING BLOCK

[76] Inventor: William D. B. Rotherham, 18 Hamilton House, 81 Southhampton Row, London, WCIB 4HA, England

[21] Appl. No.: 455,287

[22] Filed: Jan. 3, 1983

[30] Foreign Application Priority Data

Jan. 6, 1982 [GB] United Kingdom ..... 8200228

[51] Int. Cl.[3] ..... E04B 5/04

[52] U.S. Cl. ..... 52/605; 52/608; 52/663; 52/DIG. 2

[58] Field of Search ..... 52/608, 609, 663, DIG. 2, 52/311, 316, 221 R, 504, 605, 606, 607; 405/284, 286, 30, 31

[56] References Cited

U.S. PATENT DOCUMENTS

| | | | |
|---|---|---|---|
| 2,891,397 | 6/1959 | Hauer | 52/607 |
| 2,957,278 | 10/1960 | Woodworth | 52/316 |
| 3,221,459 | 12/1965 | Hamory | 52/316 |
| 3,568,387 | 3/1971 | Grabow | 52/316 |
| 3,672,110 | 6/1972 | Nordstrom | 52/608 |
| 3,759,043 | 9/1973 | Tokunaga | 52/609 |
| 3,922,864 | 12/1975 | Hilfiker | 405/285 |

FOREIGN PATENT DOCUMENTS

| | | | |
|---|---|---|---|
| 322881 | 11/1903 | France | 52/609 |
| 614100 | 12/1926 | France | 52/609 |
| 999254 | 1/1952 | France | 52/DIG. 2 |

OTHER PUBLICATIONS

Anderson Pressed Brick, Lumber Trade Journal, 7/1/1888, 2 pages.

*Primary Examiner*—Henry E. Raduazo
*Attorney, Agent, or Firm*—McAulay, Fields, Fisher, Goldstein & Nissen

[57] ABSTRACT

The invention provides a building block having a shape derived from that of a cuboid, wherein the upper corners of the front face (1) are cut-away and a recess communicates between the bottom face (2) and the rear face (3). Preferably, the sum of the depth to which the said corners are cut away backwards from the front face and the depth to which the recess extends forward from the back face is greater than the depth of the block. Thus, when the blocks are built into a wall in the conventional manner louvres are formed by the recess of one block and the adjacent cut-away portions of two blocks below. The cut-away portions at the corners may be tetrahedral or half segments of a circle or ellipse, for example. The recesses may be tetrahedral or segments of a circle or ellipse.

16 Claims, 24 Drawing Figures

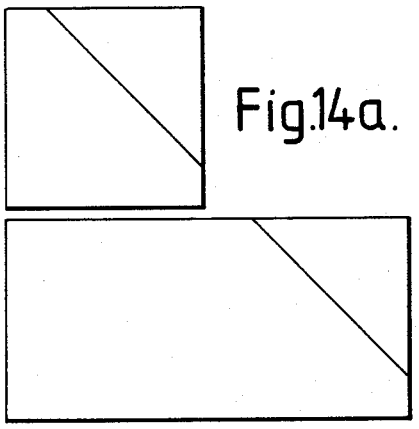
Fig.14a.
Fig.14.
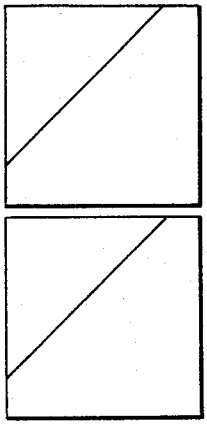
Fig.15a.
Fig.15.
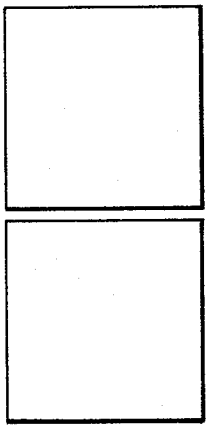
Fig.16a.
Fig.16.
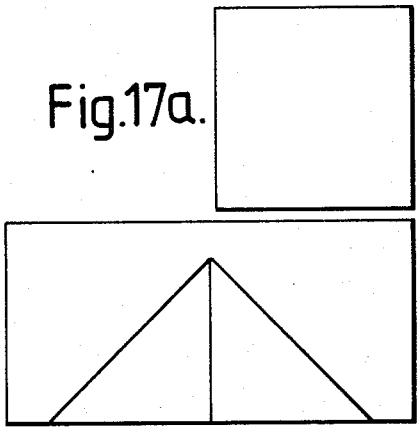
Fig.17a.
Fig.17.

BUILDING BLOCK

BACKGROUND OF THE INVENTION

The present invention relates to a building block.

BRIEF SUMMARY OF THE INVENTION

An object of the invention is to provide a simple building block which can be used to construct a louvred and/or a decorative wall or screen.

According to the present invention there is provided a building block having a shape derived from that of a cuboid, wherein the upper corners of the front face of the cuboid are cut away and wherein a recess communicates between the bottom face and the rear face.

Most preferably, the sum of the depth to which the upper corners of the front face are cut away back from the front face and the depth to which the recess extends forward from the rear face is greater than the depth of the block and preferably the recess is located centrally of the rear bottom edge. Thus, when the blocks are laid in flush rows to form a wall or screen, one row being staggered by half a block with respect to the rows above and below, a louvre-like hole is formed obliquely downwards through the wall by each recess and the cut away corners of the adjacent blocks below.

Preferably, the corners are cut away such that the shape formed by adjacent cut away portions at the corners of two blocks placed side by side corresponds to that of the recess.

The blocks can be laid back-to-front and upside-down to provide a variety of wall designs, i.e. the terms "front", "rear", "top" and "bottom" do not necessarily define the orientation of the block in use.

Further, terms such as "cut away" are not used to mean that the block of the invention is necessarily formed by removing sections from the block in the shape of a cuboid.

The term "cuboid" covers blocks having no, some or all faces square.

Preferred embodiments of the invention are described below, by example only, with reference to the accompanying drawings.

BRIEF DESCRIPTION OF THE SEVERAL VIEWS OF THE DRAWINGS

FIGS. 14 and 14*a*, 15 and 15*a*, 16 and 16*a* and 17 and 17*a* are respectively front, side, end and rear elevations of a pair of end blocks;

DETAILED DESCRIPTION

Figure 1:
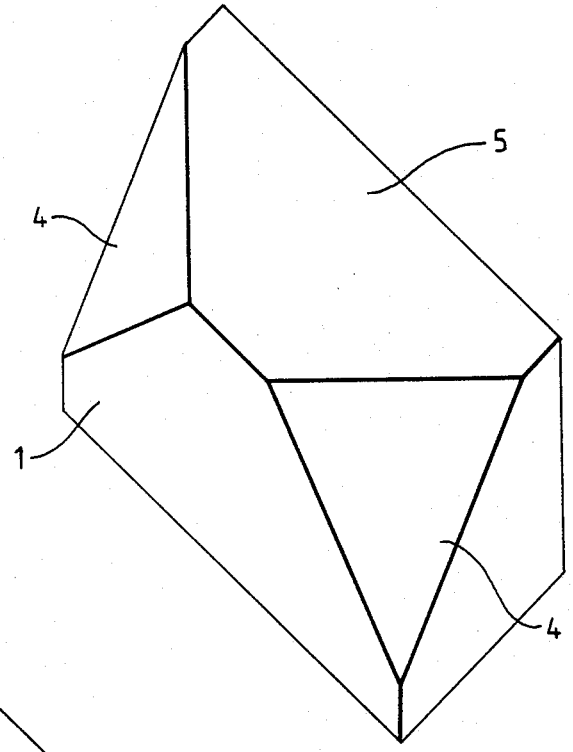
FIG. 1 is an isometric view of one embodiment of the building block, from above and in front.
Figure 2:
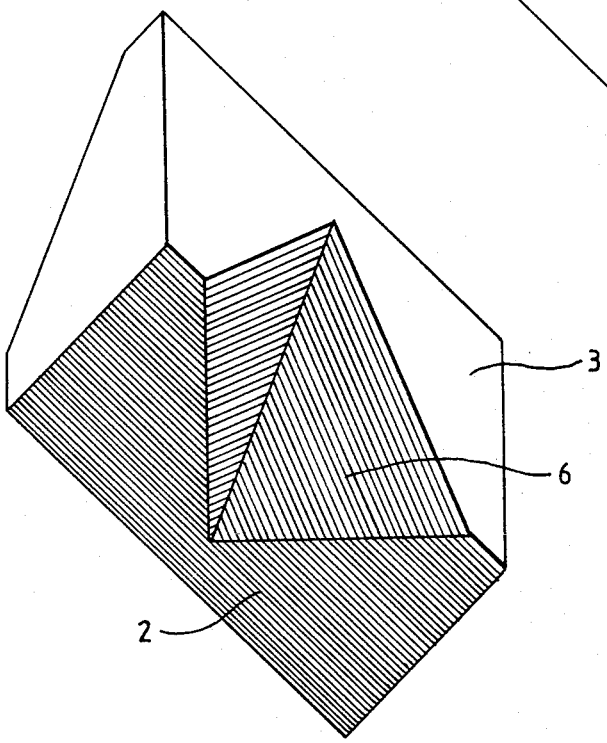
FIG. 2 is an isometric view of the block of FIG. 1, from below and behind.

As shown in FIGS. 1 and 2 the building block has a shape derived from a cuboid. The upper corners of the front face 1 are cut away and a recess communicates between the bottom face 2 and the rear face 3.

In the embodiment of FIGS. 1 and 2, the portions nominally cut away from the corners of the cuboid are tetrahedral in shape, one apex of the tetrahedron coinciding with the corner of the full cuboid. Thus oblique faces 4 are formed. In another embodiment, these oblique faces might be curved.

The recess in this embodiment is formed centrally by first cutting into the edge of the bottom and rear faces 2 and 3, near the right hand end of that edge, along a plane parallel to the right hand oblique surface 4. A similar cut is then made near the left hand end parallel to the left oblique surface. Thus, a "V" notch 6 having the shape of an irregular tetrahedron is formed between the bottom and rear surfaces 3 and 4.

The upper corners of the front face are cut away back from the front face of the block to more than half the depth (the distance between front and back faces) of the block. Similarly, the notch extends into the bottom face to more than half the block depth.

Also, since in this embodiment the end faces are square, the area cut from the top surface at each upper corner is a mirror image of the area cut from the front surface. Similarly, the area cut from the rear surface at the notch is a mirror image of the area cut from the bottom surface.

Obviously, sufficient bearing surfaces dependent on the block material must remain on the top and bottom surfaces 5 and 2 when the corners are cut away and the notch is formed to allow the building blocks to be built up one on top of the other.

Figure 3:
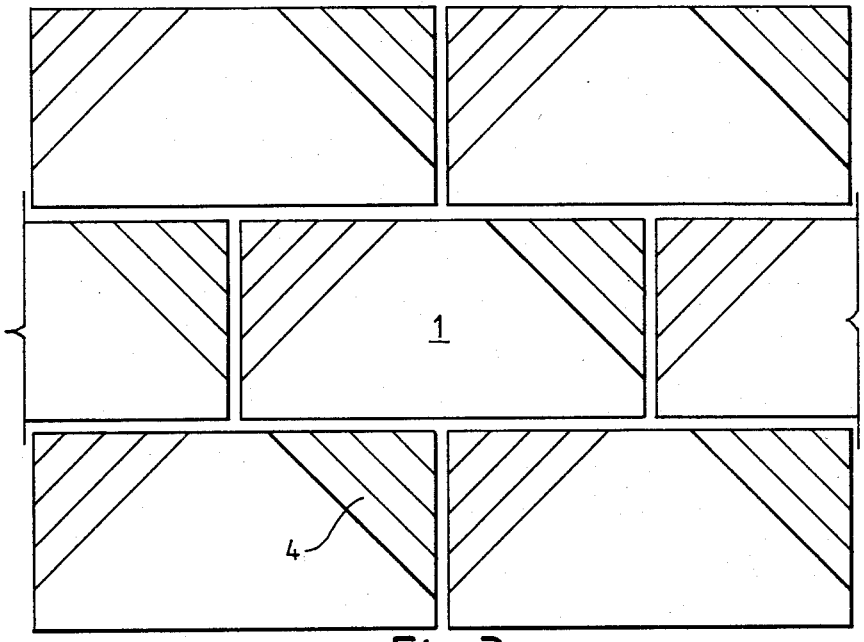
FIG. 3 is an elevation of a wall, constructed from a plurality of the blocks of FIGS. 1 and 2, from one side, cut-away portions and recesses being shown shaded.
Figure 4:
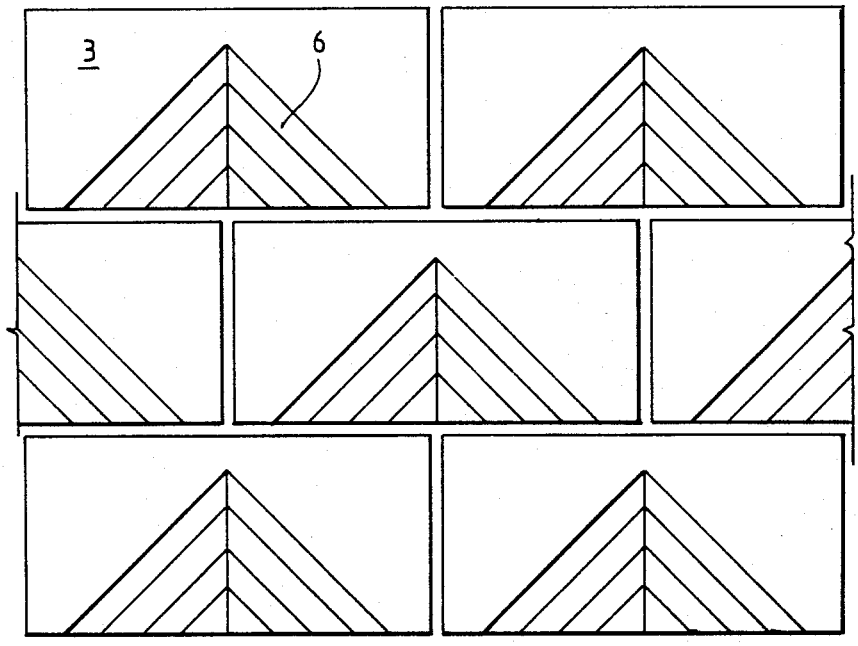
FIG. 4 is an elevation of the wall of FIG. 3 from the other side.

Rear and front end elevations of a wall constructed from the blocks of FIGS. 1 and 2 are shown in FIGS. 3 and 4. The blocks are arranged in a conventional manner, i.e. each block is laid flush and is staggered by half a block with respect to the blocks above and below. In this wall the blocks are all arranged facing the same way. Thus, the oblique surfaces 4 are all visible on the same side of the wall.

It is clear that the notch 6 opens out from the rear face 3 onto the rear of the wall. However, due to the depth of the cut away portions and notch mentioned above, the notch 6 also opens out from the bottom face 2 into a notch formed by the adjacent oblique surfaces 4 of the two blocks below. Thus, a port or louvre is formed through the wall, which port extends obliquely downwards through the wall.

Thus, the wall or screen admits ventilation and light but does not allow horizontal sight lines. In elevation, the wall appears solid and decorative. Depending on which face of the wall is the outer face, direct sunlight is either admitted or exluded. In the latter case, rain is also of course excluded.

If a decorative finish is required to the wall without there being louvres, then each row may be built with its blocks facing the opposite way to the blocks below. Thus, a decorative pattern will be achieved in that, in this embodiment, the wall would have pyramidal hollows formed by one notch 6 and the notch formed by adjacent oblique surfaces 4.

If the cut-away portions and the recess did not extend to depths the sum of which was greater than the depth of the block, then louvres would not be formed in a wall made from the blocks. In this case only a patterned decorative wall could be made.

Figure 5:
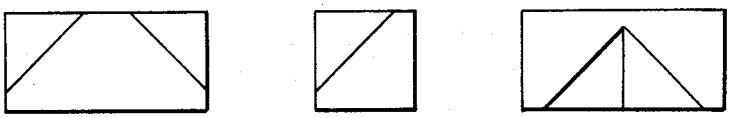
FIG. 5 shows a front view, end view and rear view of the blocks of FIGS. 1 and 2.
Figure 6:
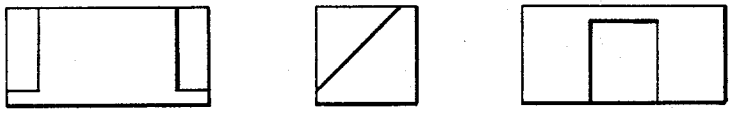
FIGS. 6 to 9 show front views, end views and rear views of other embodiments of the building block (top views are the same as front views)

Further views of the blocks of FIGS. 1 to 4 are shown in FIG. 5. Another embodiment is illustrated in FIG. 6. In this example the cut-away portions are formed by a cut parallel to one end face to a depth parallel to but short of the diagonal of the end face. The cut-away portion is completed by a cut parallel to that diagonal along the axis of the building block. The recess is formed in a similar fashion. Thus, the cut-away portions and recesses have the shape of a cuboid cut in half along a diagonal plane.

Figure 7:
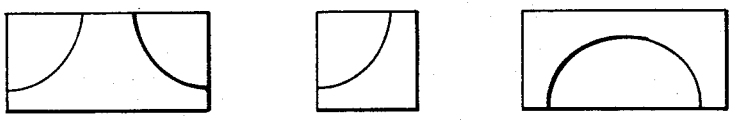

In FIG. 7, the cut-away portions are formed by half segments of a sphere and the recess is formed by a segment (in fact one quarter) of a sphere. Obviously, the segments could be those of an ellipse as well.

Figure 8:
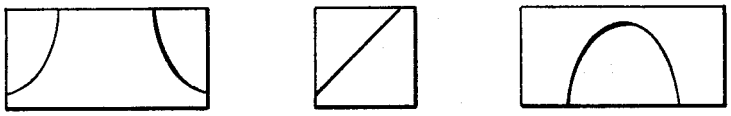

In FIG. 8, the cut-away portions are half segments of a cylindroid while the recess is a segment of a cylindroid. Obviously, segments of a cylinder could also be cut away.

Figure 9:
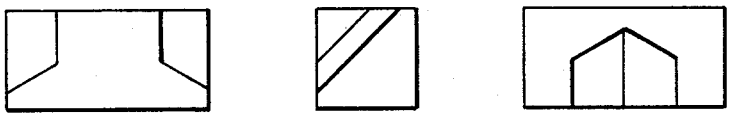

The embodiment of FIG. 9 is similar to that of FIG. 6, except that the forward facing face of the cut-away portion is not parallel to a diagonal plane of the block but is angled towards the front upper edge of the block. Correspondingly, the recess is a hexahedron.

Figure 10:
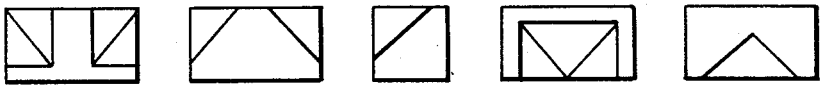
FIG. 10 shows a top, front, end, bottom and rear view of another embodiment.

In FIG. 10, the cut-away portions are similar to the notch in FIG. 2 in that they are "V"-shaped, but the cut-away portions are here pentahedral in shape. The recess extends from a rectangular shape in the bottom face to a triangular shape in the rear face and is again in the shape of an irregular pentahedron.

Figure 11:
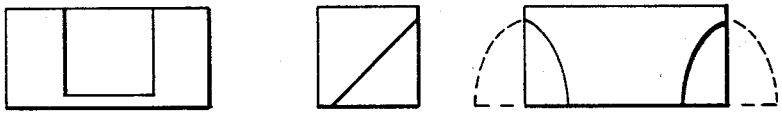
FIG. 11 shows a front view, end view and rear view of a further embodiment which has been turned upside down.

The embodiment of FIG. 11 combines a recess as in FIG. 6 with cut-away portions as in FIG. 8.

In the embodiment of FIGS. 1 to 5, FIG. 6, FIG. 7, FIG. 9 and FIG. 10, the shape of the notch formed by two adjacent cut-away portions corresponds to the shape of the recess of the block.

Further the embodiments of FIGS. 6 to 9 and 11 are similar to the embodiment of FIGS. 1 to 5 in that the areas cut from the top and front surfaces at the corners are mirror images of one another as are the areas cut from the rear and bottom surfaces at the recess.

Figure 12:
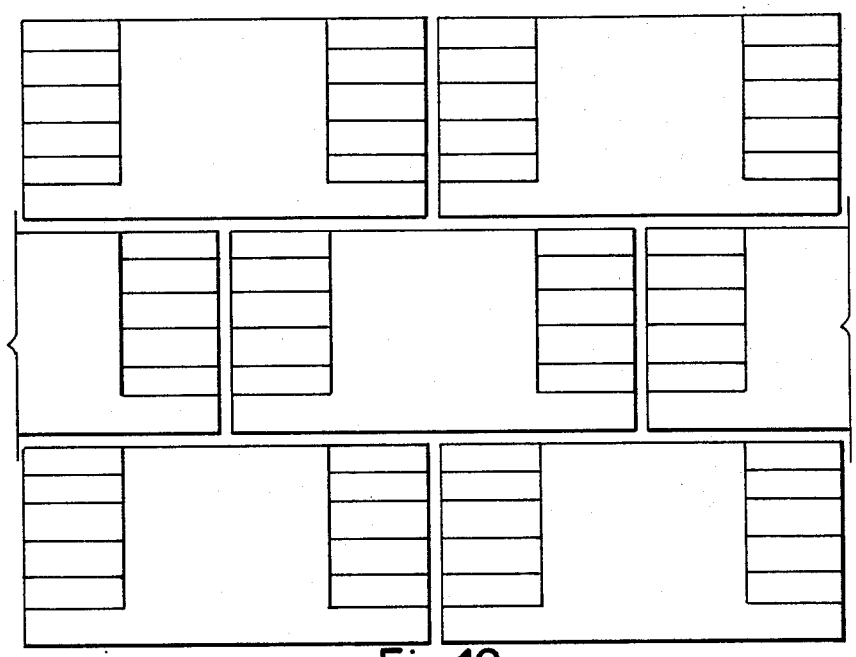
FIG. 12 is an elevation of one side of a wall constructed from a plurality of the blocks shown in FIG. 6, cut-away portions and recesses being shown shaded.
Figure 13:
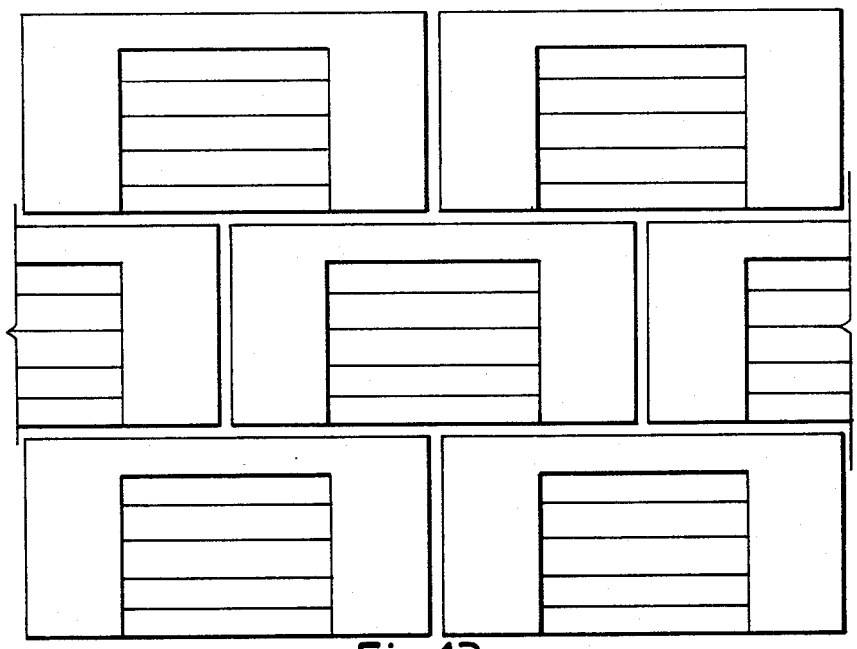
FIG. 13 is an elevation of the other side of the wall of FIG. 12.

FIGS. 12 and 13 are similar to FIGS. 3 and 4 and show the front and rear faces of a wall constructed from the blocks shown in FIG. 6. In this case the port formed by the recess of one block and the adjacent cut-away portions of two adjacent blocks below has a uniform longitudinal and lateral cross-sections, these sections being rectangular and rhomboid respectively.

In FIGS. 14 and 14*a* to 17 and 17*a* are illustrated a pair of non-reinforced end blocks in front, side end and rear elevation respectively. These end blocks match the blocks of FIGS. 1 to 5. The view of FIG. 14 and 14*a* would, for example, fit that of FIG. 3, the end block 8 of FIG. 14 finishing the left hand side of the bottom row of FIG. 3, and the end block 9 of FIG. 14*a* finishing the left hand end of the second row.

Figure 18:
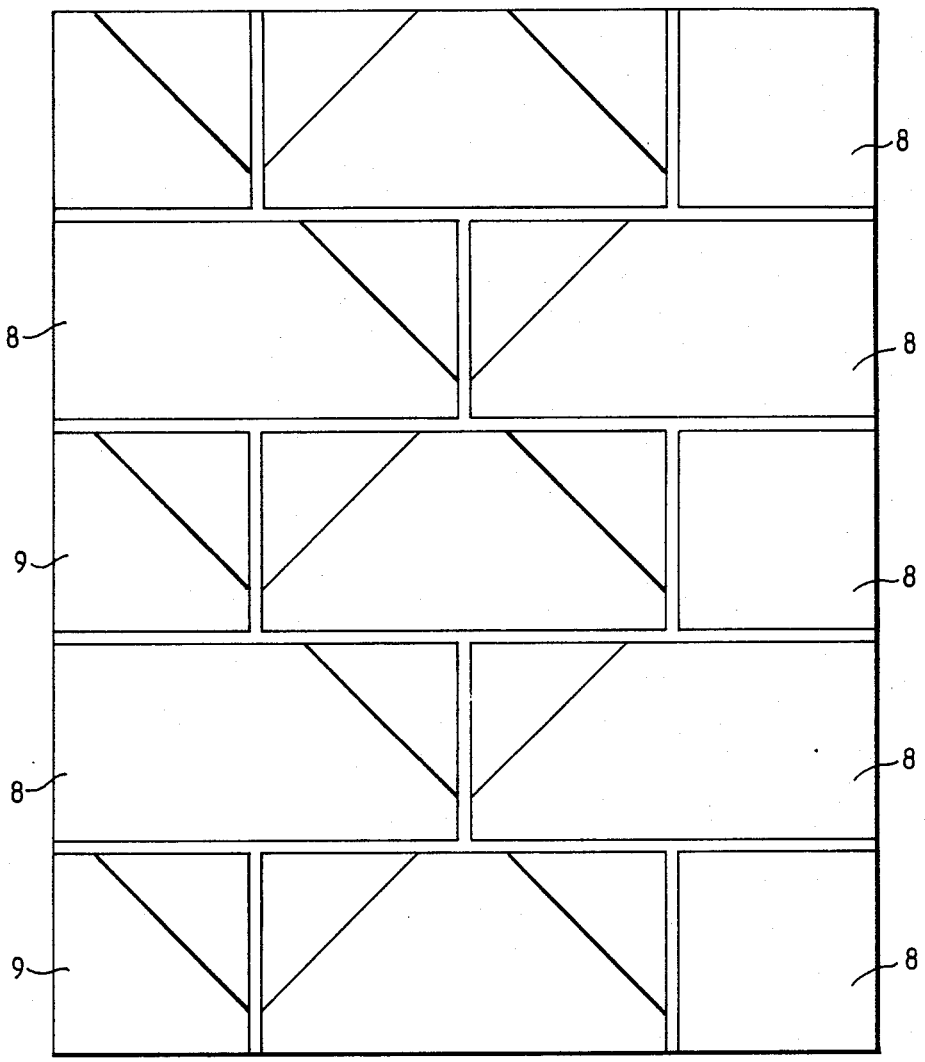
FIG. 18 is an elevation of the wall of FIGS. 3 and 4 showing possible end and corner blocks.

In FIG. 18 is seen a portion of a wall similar to that of FIG. 3 comprising end blocks 8 and half-end blocks 9, an end to this wall being seen on the left hand side. An example of a corner is seen at the right hand side of FIG. 18, the corner being constructed of end blocks 8. Such a corner is illustrated more clearly in FIGS. 19 and 19*a* if the dashed lines of FIG. 19*a* are assumed.

Figures 19, 19A:
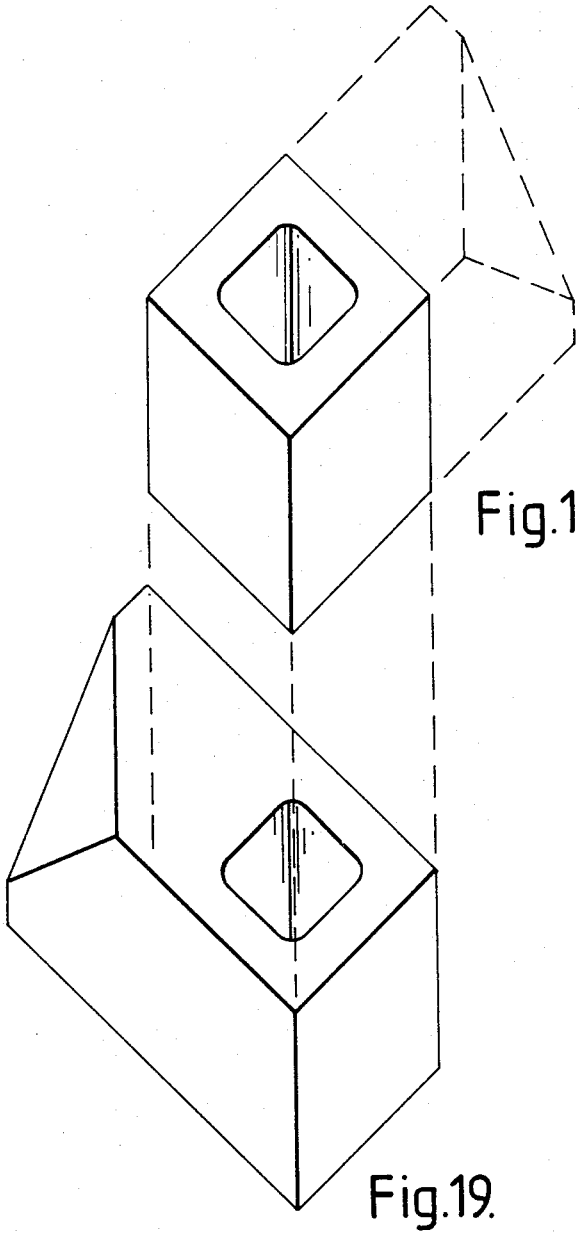
FIG. 19 and 19*a* are isometric views of a pair of corner or end blocks.

In FIG. 19 and 19*a* there are shown reinforced end blocks having a hole extending vertically therethrough so that at the end or corner of a wall a hole would extend to the full height of that wall. This hole can be used to reinforce the wall, by being filled with concrete with a steel reinforcing rod for example. These reinforced end blocks can also be used in the middle of a wall to form piers.

Thus end and corner blocks can be formed in a variety of ways: cuboids with one corner cut off and one recess (FIGS. 14 to 18); half-blocks with one corner cut off (FIGS. 14*a* to 17*a*); cuboids with one corner cut off (FIG. 19); and complete half-blocks (FIG. 19*a*).

End blocks for walls constructed of the blocks of FIGS. 6 to 11 can be designed in a corresponding fashion having regard to the shape of the cut-away portions.

Returning now to the design of the building blocks, it is clear that the recesses and cut-away portions can be designed in many different ways and those different designs may be applied to the same block.

A wall could of course be built having one row of one of one type of block and another row of a different type. Also, the blocks can be used in conjunction with blocks of the usual cuboid shape so as to provide a wall with a limited louvred area.

In any of the embodiment of the invention, the cut-away portions might extend sufficiently to cut off the lower corners of the front face of the block. This might be particularly appropriate in the embodiment of FIGS. 1 to 5 and FIG. 6.

It should also be noted that a louvred wall can also be formed if the building blocks are laid as a double-skin wall.

The blocks might be formed by moulding and might be formed of concrete, reconstructed of stone, brick, teracotta, or ceramic materials for example.

Walls made from the building blocks of the invention could serve as service enclosures, explosives enclosures, privacy screens, balcony screens, ventilated courtyard or garden walls, safety enclosures to swimming pools etc, space dividers, decorative walls, and frames for climbing plants. The walls could also give shade to windows from east and west sun-rays and could reduce light from a given opening. A particular advantage of such walls is that the louvred areas can complement the building materials of non-louvred parts of the wall.

I claim:

1. A building block having a shape derived from that of a cuboid and having top, bottom, front and rear faces and upper and lower corners, wherein the upper corners of the front face of the cuboid are cut away, part of the top face being left intact, and wherein a recess communicates between the bottom face and the rear face only, part of the bottom face and the lower corners of the rear face being left intact, the sum of the depth to which said upper corners are cut as measured from said front face and the depth to which the recess extends forwardly as measured from the rear face being greater than the depth of the cuboid.

2. A block according to claim 1, wherein the recess is located substantially centrally of the rear bottom edge of the block.

3. A block according to claim 1, wherein the corners are cut away such that the shape formed by the adjacent cut away portions at the corners of two blocks placed side by side corresponds to that of the recess.

4. A block according to claim 1, wherein the cut-away portions at the corners and the recess are tetrahedral.

5. A block according to claim 1, wherein the cut-away portions at the corner are rectangular in front and top view but triangular in end view, and the recess is rectangular in rear and bottom view but triangular in end view.

6. A block according to claim 1, wherein the cut-away portions at the corners are half segments of a sphere or ellipse and the recess is a segment of a sphere or ellipse.

7. A block according to claim 1, wherein the cut-away portions at the corners are half segments of a cylindroid or cylinder and the recess is a segment of a cylindroid or cylinder.

8. A block according to claim 1, wherein the cut-away portions at the corners are pentahedral, extending from a rectangular shape in the top face to a triangular shape in the front face, and the recess is also pentahedral, extending from a rectangular shape in the bottom face to a triangular shape in the rear face.

9. A block according to claim 1, wherein the cut-away portions extend sufficiently to cut off the lower corners of the front face of the block.

10. A wall constructed from a plurality of the blocks according to claim 1.

11. A kit of parts comprising a plurality of blocks according to claim 1 and a plurality of end or corner blocks being in the form of a cuboid having one upper corner of the front face thereof cut away.

12. A kit of parts according to claim 11 wherein at least some of some of the end or corner blocks have a recess communicating between bottom and rear faces thereof.

13. A kit of parts according to claim 12, further comprising end blocks in the form of a cuboid being half of the cuboid of the building blocks.

14. A kit of parts according to claim 13, wherein one corner of at least some of the cuboid half blocks is cut away.

15. A kit of parts according to claim 13 wherein a hole extends through at least some of the end or corner blocks between two opposite faces.

16. A block according to claim 1, in which the lower corners of the rear face provide a bottom bearing surface.

* * * * *